United States Patent [19]

Bryant et al.

[11] 3,996,776

[45] Dec. 14, 1976

[54] STRIP THICKNESS CONTROL

[75] Inventors: Greyham Frank Bryant; Peter David Spooner, both of London, England

[73] Assignee: Gec-Elliott Automation Limited, London, England

[22] Filed: Mar. 3, 1975

[21] Appl. No.: 554,608

[30] Foreign Application Priority Data

Mar. 5, 1974 United Kingdom ..... 9859/74

[52] U.S. Cl. ..... 72/9; 72/12

[51] Int. Cl.[2] ..... B21B 37/12

[58] Field of Search ..... 72/9, 8, 10, 11, 12, 72/16

[56] References Cited

UNITED STATES PATENTS

| | | | |
|---|---|---|---|
| 2,767,604 | 10/1956 | Whalen, Jr. | 72/234 |
| 3,440,846 | 4/1969 | Scott | 72/11 |
| 3,531,961 | 10/1970 | Dunn | 72/8 |
| 3,702,071 | 11/1972 | Masar | 72/19 |
| 3,709,008 | 1/1973 | Smith, Jr. | 72/8 |
| 3,740,983 | 6/1973 | Peterson et al. | 72/16 |
| 3,765,203 | 10/1973 | Peterson | 72/12 |
| 3,782,151 | 1/1974 | Peterson et al. | 72/9 |

*Primary Examiner*—Milton S. Mehr
*Attorney, Agent, or Firm*—Bacon & Thomas

[57] ABSTRACT

A system for controlling the thickness of strip in a tandem mill having at least three stands. At a first lower speed the thickness of the strip is corrected in only a first one of the stands of the mill, and at a second higher speed the thickness error is corrected only in a second one of the stands, the second stand being downstream from the first stand. At intermediate speed a thickness error correction takes place in both a first and a second stand.

11 Claims, 1 Drawing Figure

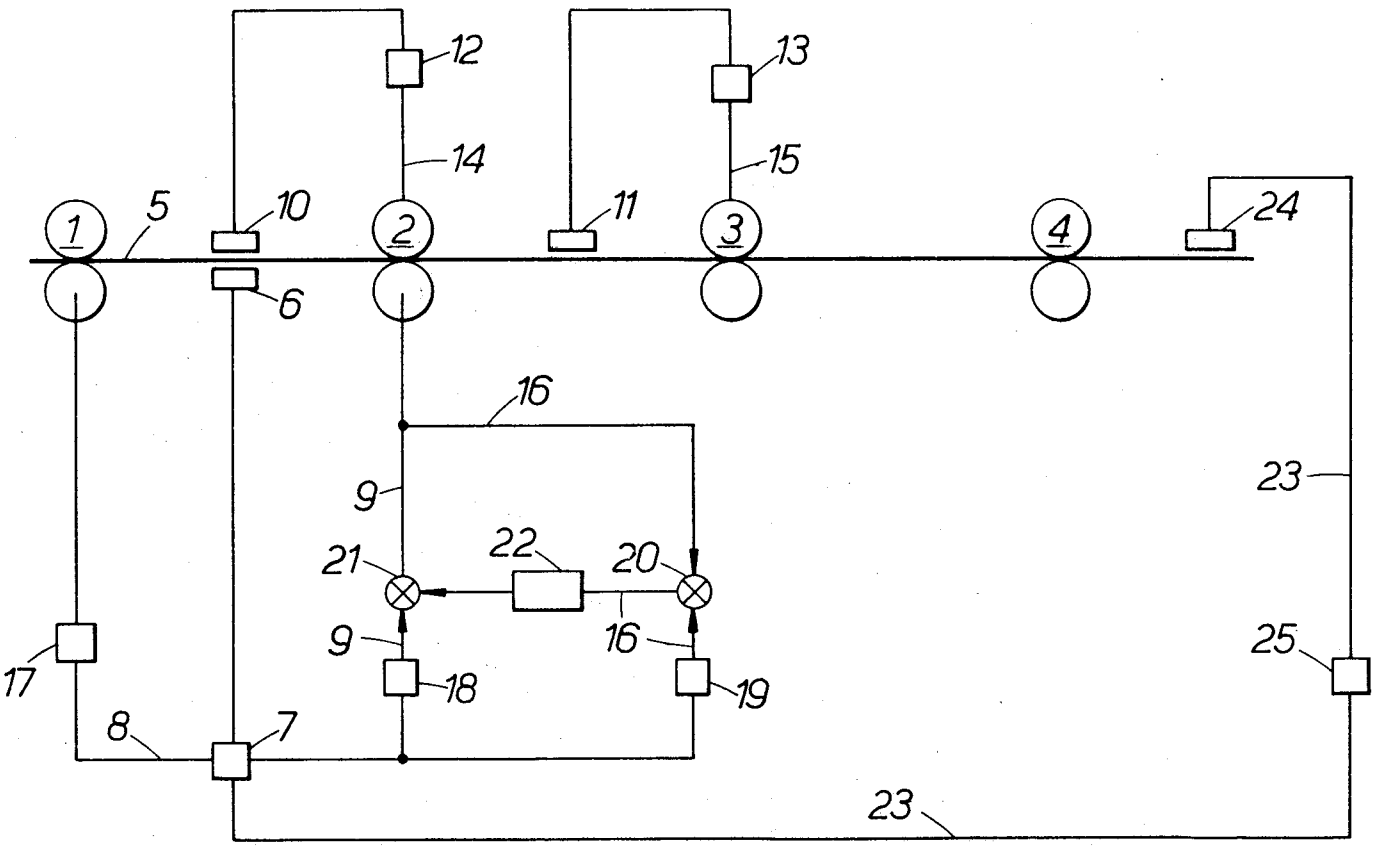
1
2
3
4
5
6
7
8
9
9
10
11
12
13
14
15
16
16
17
18
19
20
21
22
23
23
24
25

STRIP THICKNESS CONTROL

The present invention relates to strip thickness control during rolling and is particularly concerned with a method and apparatus for effecting such control automatically in a tandem mill.

In conventional strip thickness automatic control systems for tandem mills, the roll gap and motor speed at each stand is pre-selected to effect a desired reduction in strip thickness as the strip travels through each strand. Any errors in thickness are normally corrected in an intermediate stand usually by adjusting the roll gap and the speed of the rolls so as to maintain the interstand thickness of the strip within some desired tolerance.

It has been found that the desired form of the correction to the error in thickness is dependent on the strip feed speed (that is the speed at which strip enters or leaves the first stand) and the speed of response of the thickness measuring instrument and of the roll position actuator. The desired form of correction is that where part of the correction is initiated before the thickness error reaches the stand and part of the correction is applied after the error has passed through the stand so that the thickness of the strip leaving the mill is maintained substantially within the desired thickness tolerance over the whole of its length. In the conventional systems it has been found that this desired form of correction can only be obtained at one particular strip feed speed unless variable time delay circuits are incorporated into the system to vary the response time of the correction system. These variable time delay circuits are however relatively costly and are difficult to incorporate into existing systems so that their use has not found great favour.

The present invention provides a method and an apparatus for controlling the strip thickness whereby the desired form of thickness error correction is obtained over a wide range of strip feed speeds without the use of variable time delays.

According to one aspect of the present invention a method for controlling the thickness of a strip in a tandem mill having at last three stands comprises sensing an error in strip thickness and correcting the error in at least one stand downstream from the point where the error is sensed whereby to minimise the error, the stand or stands in which the error is corrected being selected in dependence upon the strip feed speed in a manner whereby the proportion of the error corrected in the stand first, and in the stand next, applying correction varies respectively as an inverse and as a direct function of the strip feed speed so that increase in strip feed speed moves the error correction downstream away from, and decrease in strip feed speed moves the error correction upstream towards, the point where the error is sensed.

In this way the desired form of correction referred to above is obtained irrespective of strip speed and despite the fact that the speed of response from the sensor to the roll position actuator is fixed. Accordingly the thickness of the strip emerging from the last stand applying correction will be found to be maintained substantially within the desired value.

Preferably the correction involves generating an error signal representative of the error in strip thickness and feeding the signal to adjust the roll speed in all stands upstream and in at least one stand downstream from the point where the error is sensed so as to provide a variation in roll speed in proportion to the signal. In this case the gain of the signal fed to any downstream stand is varied in dependence upon the given strip feed speed so that the proportion of the error corrected in any down-stream stand is dependent upon the strip feed speed.

Suitably the ratio of the correction applied in the stands at any given strip feed speed is modified during the occurrence of a long term error in strip thickness so as to distribute the rolling loads between the stands and avoid concentrating the load in only one of the stands.

Conveniently during the occurrence of a long term error in strip thickness the gain of the signal fed to any downstream stand is modified so that the ratio of the roll speeds is adjusted to a preselected ratio. This enables the proportion of the error correction applied in the stands to be modified so that the rolling loads are distributed between the stands so as to avoid concentrating the load on only one stand.

The correction may also involve sensing between at least two adjacent sets of stands any resulting error in interstand tension and generating an error signal representative of the error in tension. This signal may be arranged to adjust the roll gap in the next stand downstream from the point where the error in tension is sensed in order to minimise the respective tension error and thereby substantially minimise the error in strip thickness.

The error in strip thickness may be corrected in either one or both of the two stands immediately downstream of the point where the thickness error is sensed.

In this case, where the strip feed speed is slow the thickness error is corrected in the first downstream stand, where the strip feed speed is fast the thickness error is corrected in the second or a subsequent downstream stand and at intermediate strip feed speeds the error correction is shared between the stands. It will be appreciated that the designation of fast, slow or intermediate speed is dependent on the characteristic time delay between the sensor and the correction points and the response characteristics of the actuators and the measurement instrument.

According to another aspect of the present invention apparatus for controlling the thickness of a strip in a tandem mill having at least three stands comprises a sensor for sensing an error in strip thickness, a correction system for correcting the error in at least one stand downstream from the sensor whereby to minimise the error, the correction system being adapted to vary the proportion of the error corrected in any downstream stand in dependence upon the strip feed speed in a manner whereby the proportion of the error corrected in the stand first, and in the stand next, applying correction varies respectively as an inverse and as a direct function of strip feed speed so that increase in strip feed moves the error correction downstream away from, and decrease in strip feed speed moves the error correction upstream towards, the sensor.

Preferably the correction system includes a generator for generating an error signal representative of the error in strip thickness and a circuit for feeding the error signal to adjust the roll speed in all stands upstream and in at least one stand downstream from the sensor so as to provide a variation of roll speed in proportion to the signal. In this case the correction system also includes a circuit having a gain value variable with strip feed speed, the circuit being effective to vary the proportion of the error corrected in any downstream stand in dependence upon the given speed of the strip.

Suitably, the correction system includes a control circuit which is effective to modify the ratio of the correction applied in the stands at any given speed during the occurrence of a long term error in strip thickness so as to distribute the rolling loads between the stands and avoid concentrating the load in only one of the stands. In the absence of such a circuit the rolling loads at certain strip feed speeds will be concentrated on only one of the stands. In the short term this could overload the stand drive motors and/or give rise to bad strip shape. If the rolling load concentration is maintained over a long period of rolling there may be an undesirable effect in the thermal crown of the rolls and in the shape of the strip. This in turn may lead to threading problems and make overall mill working difficult.

Conveniently, the control circuit is effective to modify during the occurrence of a long term error the gain of the thickness error signal fed to any downstream stand so that the ratio of the roll speeds is adjusted to a preselected ratio. This enables the proportion of the error correction applied in each stand to be modified so that the rolling loads are distributed between the stands so as to avoid concentrating the load on only one stand.

The correction system may further include sensors for sensing any resultant error in interstand tension between at least two sets of adjacent stands, generators responsive to the tension error and capable of generating an error signal representative of the tension error and a circuit for feeding each tension error signal to adjust the roll gap in the next stand downstream of the respective tension sensor so as to minimise the respective tension error and thereby substantially minimise the error in strip thickness.

Suitably the sensor for sensing an error in strip thickness includes an X-ray gauge to measure strip thickness, the X-ray gauge preferably, being located, in use, between two stands. Alternatively the sensor for sensing an error in strip thickness includes a gauge meter, well known in the art, for location at any convenient stand.

An embodiment of the invention will now be particularly described with reference to the accompanying drawing which shows schematically a strip thickness control system in a four stand rolling mill for metal trip such as steel strip.

In the drawing the four stands are designated by the four sets of rolls 1, 2, 3, and 4. Inputs to the lower rolls indicate control for the speed of the rolls while inputs to the upper rolls indicate controls for adjusting the roll gap on each of the rolls. Strip 5 is shown extending between the stands.

Referring to the drawing the apparatus incorporates a sensor 6 for sensing an error in strip thickness from its desired value and a correction system including a thickness error signal generator 7, a circuit 8 for feeding the signal to adjust the roll speed in stand 1, a circuit 9 associated with circuit 8 and having a gain value variable with the speed of the strip for feeding the error thickness signal to adjust the roll speed in stand 2, tension sensors 10 and 11 for sensing errors in tension in the strip between stands 1 and 2 and 2 and 3 respectively, tension error signal generators 12 and 13 responsive to sensors 10 and 11 and circuits 14 and 15 for feeding the tension error signals to adjust the roll gap in stands 2 and 3 respectively. The correction system also includes a control circuit 16 which is effective to modify the thickness error signal adjusting the roll speed of stand 2 so as to modify the proportion of the correction applied at stand 2 and stand 3.

The sensor 6 is located normally in use between stands 1 and 2 and in this case sensor 6 includes an X-ray gauge (not shown) for measuring the strip thickness leaving stand 1. The sensor 6 generates a signal representative of this measured strip thickness and this is compared in a manner well known in the art with a reference signal representative of the desired strip thickness to that any error in strip thickness is sensed and fed to generator 7 which generates an error signal representative of the error in strip thickness. This thickness error signal is fed via circuit 8 and gain 17 to the roll motor of stand 1 in order to adjust the speed of the rolls and maintain a constant volume of strip input to the mill in unit time. The thickness error signal is also fed via circuit 9 to the roll motors of stand 2 in order to adjust the roll speed in this stand. Circuit 9 includes a gain 18 which is of a type having a variable gain value, the gain value varying as a function of the speed of the strip at any point in the mill. Thus the gain 18 is capable of varying the proportion of the thickness error signal fed to stand 2 thereby varying the proportion of correction applied in stand 2 and as will be shown in stand 3. The full effect of variable gain 18 will be described later.

The tension error sensors 10 and 11 are disposed between stands 1 and 2 and stand 2 and 3 respectively so as to sense any errors in tension resulting from the charge of speed occurring in the rolls of stands 1 and 2. The sensors 10 and 11 incorporate tensiometers well known in the art for measuring tension. Sensors 10 and 11 each generate a signal representative of the measured tension between their respective stands and this signal is compared in a manner well known in the art with a reference signal representative of the desired tension so that any error in strip tension is sensed and fed to the respective generators 12, 13 which generate error signals representative of the error strip tension. For strip located between stands 1 and 2 the signal produced by generator 12 is fed via circuit 14 in a manner well known in the art to adjust the roll gap in stand 2 and correct the error in tension between stands 1 and 2. Similarly the tension error signal produced for strip located between stands 2 and 3 is fed from generator 13 via circuit 15 to adjust the roll gap in stand 3 and correct the error in tension between stands 2 and 3.

The operation of the control system so far described is as follows. When an error is strip thickness is detected by sensor 6, an error signal is generated by generator 7 and is fed to the roll motor of stand 1 so as to alter the speed of the rolls and maintain a constant volume throughput of strip. The effect of the speed change in the rolls of stand 1 is to produce an error in the tension between stands 1 an 2. This error is sensed by sensor 10 and an error is generated by generator 12 which feeds an error signal via circuit 14 to adjust the roll gap in stand 2 so as to correct the error in tension and thereby the error in strip thickness. At one particular strip speed the correction in the error in thickness will be in the desired form well known in the art, that is, in a form where half of the correction is applied before the thickness error reaches stand 2 and half of the correction is applied after the error has passed through stand 2 so that the thickness of the strip emerging from stand 2 is maintained substantially within the desired value. This is found to be the slowest speed at which the control system is capable of effecting the desired form of thickness error correction. At strip speeds higher than this however the correction is applied too late so that the error has reached stand 2 before half the correction can be made. The desired form of correction may still be obtained by sharing the correction between stands 2 and 3 so that a proportion of the error is corrected in the stands. This is achieved by means of the gain 18 which as previously stated has a gain which is variable with the speed of the strip. In the case described here the gain is variable from 0 to 1.

At the slowest speed described the gain is set at 0 so that no thickness error signal is fed to the roll motor of stand 2 via circuit 9. Since the speed of the rolls in stand 1 has been altered but that of the rolls in stand 2 has not, a change in strip tension occurs between stands 1 and 2 so that in error in strip tension arises. This error in tension is sensed by sensor 10 and an error signal is generated in generator 12 which is fed by circuit 14 to adjust the roll gap of stand 2 and correct the error in tension and thereby the error in thickness. In this case all the correction in thickness is applied in stand 2.

As the speed of the strip is increased, the gain in gain 18 is gradually increased so that a proportion of the thickness error signal is fed to the roll motor of stand 2 to alter the speed of the rolls. The speed change between the rolls of stand 1 and 2 is therefore reduced so that the change in strip tension between stands 1 and 2 and there by the error in tension is also reduced. Consequently the proportion of the error corrected at this stand is also reduced. At the same time since the roll speed in stand 2 has been altered, a tension change occurs in the strip between stands 2 and 3. This tension change is sensed as an error in tension and the error signal generated is fed via circuit 15 to adjust the roll gap in stand 3 so as to correct the error in tension and thereby complete the correction of the error in strip thickness according to the desired form.

At the highest strip speed gain 18 is set equal to gain 17 so that equal signals are fed to the roll motors of stands 1 and 2. In this case there will be little or no change in strip tension between stands 1 and 2 because the speeds of the rolls in stands 1 and 2 will have been altered by the same proportion. However a change in strip tension between stands 2 and 3 will occur because of the alteration in roll speeds between stands 2 and 3. Thus sensor 11 will sense a large error in strip tension and an error signal will be generated which will be fed via circuit 15 to alter the roll gap of stand 3 so as to correct the tension error and thereby the strip thickness. In this case therefore the error in thickness will be corrected totally at stand 3 and no correction will be effected at stand 2.

During the occurrence of a long term error in thickness and at the extremes of strip mentioned above the rolling load will be concentrated on the stand where the whole of the error is being corrected. As mentioned previously this can have undesirable effects in thermal crown of the rolls and in the shape of the strip. For this reason the thickness error signal fed to the roll motor of stand 2 is adjusted during the occurrence of a long term error by the control circuit indicated generally by 16 in the drawing so that the signal becomes equal to a half of the signal being fed to the roll motor of stand 1.

Control circuit 16 includes a gain 19, summing amplifiers 20 and 21 and an integrator 22, the integrator 22 having a variable gain (not shown). Gain 19 should be a half of the gain of gain 17 to achieve equal loading of stands 2 and 3.

The thickness error signal is fed via circuit 16 and gain 19 to the summing amplifier 20, where it is compared with the signal being fed through circuit 9 to the roll motor of stand 2. The difference between these two signals is applied to the input of integrator 22. The output of integrator 22 is added to the signal being fed to the roll motor of stand 2 by means of summing amplifier 21. When the input of integrator 22 has reached zero the signal being applied to the roll motor of stand 2 is equal to the thickness error signal amplified by gain 19. In order that the operation of the control circuit does not interfere with the desired form of error correction mentioned previously the gain of interger 20 may be reduced as the strip speed is reduced.

The apparatus may also include a feedback circuit 23 for feeding back any error in the thickness of strip leaving the last stand (stand 4). In this case the strip thickness is measured by an X-ray gauge (not shown) which is contained in a sensor 24 located after stand 4. The sensor 24 generates a signal representative of the measure of final strip thickness and this is compared with a reference signal representative of the desired final thickness so that any errors in strip thickness can be sensed. Generator 25 generates an error signal representative of the error in strip thickness and this signal is fed back via circuit 23 to error signal generator 7 so that the thickness error signal fed from generator 7 to the roll motors of stands 1 and 2 is compensated to take account of the error in thickness of the strip leaving stand 4.

We claim:

1. A method of controlling the thickness of a strip in a tandem mill, having at least three roll stands, to produce output strip of the desired thickness, the method comprising the steps of:

1. at a first lower strip speed (a) sensing an error in strip thickness between a first and a second stand, said second stand being downstream from said first stand and (b) correcting the thickness error solely in said second stand,
2. at a second higher strip speed (a) sensing an error in strip thickness between the first and second stand and (b) correcting the thickness error in at least one stand downstream from said second stand, and making no thickness error correction in the second stand,
3. at strip speeds intermediate between said first and said second speeds (a) sensing an error in strip thickness between the first and second stand and (b) correcting the thickness error both in the second stand and in at least one stand downstream from said second stand, the proportion of error corrected in the second stand decreasing as said speed rises between said first and second speeds and the proportion of thickness error being corrected in the stands downstream from said second stand increasing as speed rises between said first and second speeds.

2. A method according to claim 1 further comprising the step of modifying the proportion of error corrected in the stands at any given strip feed speed while sensing a long term error in strip thickness so as to distribute rolling loads between the stands and avoid concentrating the load in only one of the stands.

3. A method according to claim 2 wherein the step of modifying the proportion of error corrected comprises adjusting the speed of said roll stands to a predetermined ratio.

4. A method according to claim 1 wherein said correcting steps (1) and (3) comprise the steps of sensing strip tension between said first and second stands and adjusting the roll stand gap of said second stand in response to said strip sensed tension.

5. A method according to claim 1 wherein said second stand and said at least one stand downstream of said second stand are stands positioned most immediately downstream of the point where the thickness error is sensed.

6. Apparatus for controlling the thickness of strip in a tandem mill, having at least three stands each having rolls therein, to produce output strip of a desired thickness said apparatus comprising:

1. a strip thickness error sensing means having a sensor portion mounted between a first and a second stand, said second stand being downstream from said first stand, said strip thickness error sensing means producing a strip thickness error signal,
2. first speed correction means responsive to said strip thickness error signal for adjusting the speed of rotation of the rolls of the first stand,
3. first tension error sensing means having a sensor portion connected between said first and second stands for sensing strip tension resulting from strip speed differences at said first and second stands, said first tension error sensing means producing a first tension error signal,
4. first roll gap adjustment means responsive to said first tension error signal for adjusting the roll gap of said second stand,
5. second speed correction means for adjusting the speed of rotation of the rolls of said second stand,
6. variable gain control means, having a gain which is responsive to the speed of flow of the strip said gain being at a minimum at a first lower strip speed and at a maximum at a second higher strip speed, said variable gain control means having an input and an output,
7. means for feeding said strip thickness error signal to the input of said variable gain control means,
8. means for feeding the output of said variable gain control means to said second speed correction means to control the speed adjustment of the rolls of said second stand,
9. second tension error sensing means having a sensor portion connected between said second and a third stand for sensing strip tension resulting from strip speed differences at said second and third stands, said third stand being downstream from said second stand, said second tension error sensing means producing a second tension error signal, and
10. second roll gap adjustment means responsive to said second tension error signal for adjusting the roll gap of said third stand.

7. Apparatus according to claim 6 comprising: control circuit means for modifying the ratio of the roll gap adjustment applied in said second and third stands during the occurrence of a long term strip thickness error signal so as to distribute the rolling loads between the second and third stands and avoid concentrating the loads in only one of the second and third stands.

8. Apparatus according to claim 7 wherein the control circuit means modifies the strip thickness error signal to said second speed correction means so that the speed of rotation of the rolls of said first and second stand is adjusted to a preselected ratio.

9. Apparatus according to claim 6 wherein the sensor portion of said strip thickness error sensing means comprises an x-ray gauge to measure strip thickness.

10. Apparatus according to claim 6 wherein said first speed correction means comprises a fixed gain amplifier.

11. Apparatus according to claim 10 wherein said variable gain control means comprises a variable gain amplifier having a gain which is variable from a minimum value of zero to a maximum value equal to the gain of said fixed gain amplifier.

* * * * *